United States Patent [19]

Binët et al.

[11] Patent Number: 4,472,215

[45] Date of Patent: Sep. 18, 1984

[54] CONTINUOUS METHOD AND APPARATUS FOR THE PREPARATION OF EXPLOSIVES EMULSION PRECURSOR

[75] Inventors: Réjean Binët, St. Bruno; Chang-Hwa Chin, Mississauga; Anthony C. F. Edmonds, Burlington; Ming C. Lee, Longueuil; Roland Picard, McMasterville, all of Canada

[73] Assignee: C-I-L Inc., North York, Canada

[21] Appl. No.: 478,292

[22] Filed: Mar. 24, 1983

[30] Foreign Application Priority Data

Apr. 2, 1982 [CA] Canada ..... 400386

[51] Int. Cl.[3] ..... D03D 23/00

[52] U.S. Cl. ..... 149/109.6; 149/2; 149/46; 149/61; 422/163

[58] Field of Search ..... 149/109.6, 2, 46, 61; 422/163

[56] References Cited

U.S. PATENT DOCUMENTS 4,138,281 2/1979 Olney et al. ..... 149/44 X

*Primary Examiner*—Stephen J. Lechert, Jr.

[57] ABSTRACT

A process and apparatus is provided for the continuous manufacture of a water-in-oil explosive emulsion precursor. Separate streams of the water phase component and the oil phase component are introduced into an in-line motionless mixer. A chosen portion of the output from the mixer is recirculated and returned to the motionless mixer for further emulsification. The process allows for the production of a very high phase ratio water-to-oil emulsion (up to 95% water phase) without phase inversion after long storage. The precursor is simply converted to a sensitive explosive by means of known density lowering techniques.

6 Claims, 1 Drawing Figure

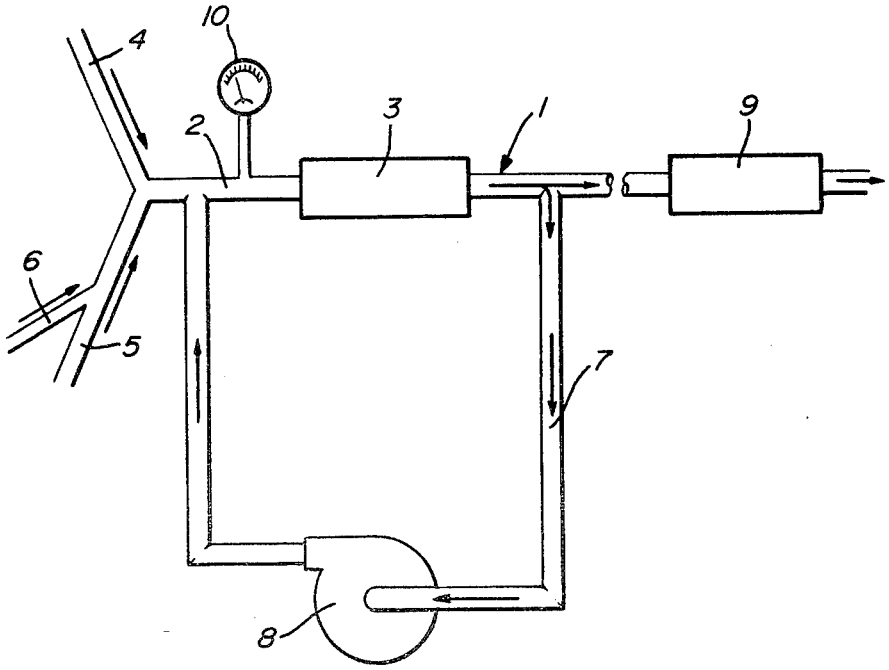
10
4
2
3
1
9
6
5
7
8

CONTINUOUS METHOD AND APPARATUS FOR THE PREPARATION OF EXPLOSIVES EMULSION PRECURSOR

The present invention relates to a method and apparatus for the continuous manufacture of an emulsified water-in-oil precursor for emulsion explosives. In particular, the invention relates to the continuous production of an emulsified precursor for emulsion explosives employing a mixing zone containing a motionless mixer. By explosive emulsion precursor is meant a composition which is substantially insensitive to initiation except by strong boostering but which can be converted into a useful and often cap-sensitive explosive by the lowering of its density by, for example, the inclusion therein of minute gas bubbles or particulate void-containing material such as glass or resin microspheres.

Water-in-oil emulsion explosives are now well known in the explosives art and have been demonstrated to be safe, economic and simple to manufacture and to yield excellent blasting results. Bluhm, in U.S. Pat. No. 3,447,978, disclosed an emulsion explosive composition comprising an aqueous discontinous phase containing dissolved oxygen-supplying salts, a carbonaceous fuel continuous phase, an occluded gas and an emulsifier. Since Bluhm, further disclosures have described improvements and variations in water-in-oil explosives compositions.

These include U.S. Pat. No. 3,674,578, Cattermole et al., U.S. Pat. No. 3,770,522, Tomic, U.S. Pat. No. 3,715,247, Wade, U.S. Pat. No. 3,675,964, Wade, U.S. Pat. No. 4,110,134, Wade, U.S. Pat. No. 4,149,916, Wade, U.S. Pat. No. 4,141,917, Wade, U.S. Pat. No. 4,141,767, Sudweeks & Jessup, Canadian Pat. No. 1,096,173, Binet & Seto, U.S. Pat. No. 4,111,727, Clay, U.S. Pat. No. 4,104,092, Mullay, U.S. Pat. No. 4,231,821, Sudweeks & Lawrence, U.S. Pat. No. 4,218,272, Brockington, U.S. Pat. No. 4,138,281, Olney & Wade, U.S. Pat. No. 4,216,040, Sudweeks & Jessup.

Emulsion explosive compositions have, in most instances, been manufactured in commercial quantities by means of batch processes employing conventional high-shear mixing apparatus. Generally, the prior art has not been specific in suggesting any particular mixing or emulsifying apparatus or techniques, references usually being made merely to "agitation" or "mixing" or "blending" of the aqueous phase and the oil phase in the presence of an emulsifier. Cattermole et al, in U.S. Reg. No. 28,060, refer to the use of a turbine mixer. Chrisp, in U.S. Pat. No. 4,008,108, refers to a high shear mixer, that is, a shear pump. Olney, in U.S. Pat. No. 4,138,281, suggests the possible use of a continuous recycle mixer, for example, the VOTATOR (Reg TM) mixer, an in-line mixer, for example, the TURBON (Reg TM) and a colloid type mixer, for example, the OAKES (Reg TM). In recent Canadian Pat. No. 1,106,835, Aanonsen et al refer to the potential utility and advantages of an in-line motionless or "static" mixer for emulsion explosives manufacture, but the inventors note that such a mixer is deficient since it does not generally achieve adequate dispersion of the fuel phase liquid in the aqueous oxidizer salt phase, especially where the fuels are viscous or where the emulsified composition has a relatively high viscosity. Aanonsen et al state that, to date, it has been necessary to employ mechanically driven mixing means to produce adequate emulsion compositions.

It is self-evident that in the manufacture of any sensitive explosive material, the use of mechanical mixers with the ever-present risk of breakdown and impact should be avoided. In addition, the generation of heat by any high shear mechanical mixing device produces additional hazard. Furthermore, with mechanical mixers production rates are limited and, often, capital investment is high.

Notwithstanding the commonly held belief that an in-line, static or motionless mixer is an inappropriate apparatus for the manufacture of high phase ratio water-in-oil emulsion explosives, applicants have now found that a conventional in-line static mixer can be adapted for the efficient production of a highly viscous and stable high phase ratio explosive emulsion precursor which is superior to emulsions prepared with high shear mechanical mixers, and without the attendant risks.

By "in-line static mixer" is meant a hollow, generally tubular element containing one or more stationary, perforated or slotted elements which achieve mixing by dividing and sub-dividing a fluid flow passing therethrough. Typical of such static mixers is, for example, the SULZER mixer manufactured by Sulzer Brothers Limited of Switzerland. By high phase ratio water-in-oil emulsion is meant an emulsion composition wherein the amount of the dispersed aqueous phase comprises at least 90% by weight of the total compositions and may comprise as much as 95% by weight or more of the total composition.

For purposes of an explosive composition, intimate contact between the oxygen-rich oxidizer salt phase and the carbonaceous fuel phase is required and a very small droplet size and distribution is particularly desirable. Such a finely homogenized composition tends to be quite viscous, especially where the fuel phase comprises as little as 5% by weight of the total composition. Standard colloid mills and blenders are not normally capable of forming such high phase-ratio, small droplet emulsions and recourse has been taken to the use of high shear, high power consumption mixing devices with their attendant high operating cost, relatively low productivity and potential hazard.

By employing a mixing zone comprising a conventional in-line static or motionless mixer having a recirculation loop through which a chosen proportion of the mixed and emulsified product may be passed again through the static mixer, applicants have found that continuous production of high phase ratio emulsions can be achieved without any of the inherent disadvantages of prior art methods.

In order to provide a better understanding of the invention, reference is made to the accompanying drawing, which shows a schematic representation of the process of the invention.

Referring to the drawing, there is shown a mixing zone, generally designated by 1. Zone 1 consists of horizontal pipe or tube 2 containing an in-line static mixer 3. Leading into pipe 2 is aqueous phase inlet 4 and oil phase inlet 5. Connected to oil inlet 5 is emulsifier inlet 6. Direction of flow in all piping is indicated by the arrows. A pipe loop 7 containing pump 8 is shown on each side of static mixer 3. A second, optional static mixer in pipe 2 beyond loop 7 is shown at 9. A pressure or flow gauge is shown at 10.

The preparation of a high phase ratio water-in-oil emulsion explosive precursor composition will be described with reference to the drawing. The oil or fuel component of the composition may comprise, for example, a variety of saturated or unsaturated hydrocarbons including petroleum oils, vegetable oils, mineral oils, dinitrotoluene or mixtures of these. Optionally, an amount of a wax may be incorporated in the fuel component. Such a fuel component is stored in a holding tank (not shown) which tank is often heated to maintain fluidity of the fuel component. The fuel is introduced into mixing zone 1 through inlet conduit 5 by means of a metering type pump (not shown) or similar means. An emulsifier, such as for example sorbitan mono-oleate, sorbitan sesqui-oleate or Alkaterge T (Reg TM) is proportionally added to the fuel component in conduit 5 via conduit 6. Alternatively, the emulsifier may be incorporated into the fuel component in the fuel reservoir (not shown). The amount of emulsifier added generally comprises from about 0.4 to 4% by weight of the total composition. An aqueous solution of oxidizer salt containing 70% or more by weight of salts selected from ammonium nitrate, alkali and alkaline earth metal nitrates and perchlorates, amine nitrates or mixtures thereof, is delivered from a heated tank or reservoir (not shown) by means of metering pump (not shown) to mixing zone 1 through conduit inlet 4. The oxidizer salt solution is maintained in a supersaturated state. The rate of flow of the fuel/emulsifier component and the oxidizer salt solution component can be adjusted so that the resultant mixture is in a desired high phase ratio typically, for example, 94% by weight of the oxidizer phase to 6% by weight of the fuel/emulsifier phase. In actual operation, recirculation pump 8 in recirculation loop 7 is first activated and the fuel/emulsifier component is introduced into pipe 2, passed through static mixer 3 and recirculated through loop 7. When substantially all of the volume of loop 7 has been filled with the fuel/emulsifier component, the aqueous oxidizer component is then metered into pipe 2 where it forms a crude mixture with the fuel/emulsifier component. The crude mixture then passes through static mixer 3 where it is converted into a coarse water-in-oil emulsion. A proportion, at least 80% and up to 95% by volume of the coarse emulsion is drawn through recirculation loop 7 by pump 8 and returned to the crude stream in pipe 2 and passed again through static mixer 3. Thus a large proportion is thus repeatedly recirculated through loop 7. By first substantially filling the mixing zone 1 with a stream of fuel/emulsifier component and thereafter adding a metered amount of the aqueous salt component to this fuel stream, dominance of the fuel/emulsifier component as the continuous phase of the resultant emulsion is accomplished at the outset of the production run. By recirculating a large portion of the coarse emulsion through loop 7, a continuous fuel phase dominance in the emulsion product is maintained. The amount of recirculated product drawn through loop 7, essential to maintain dominance of the fuel phase, will vary depending on such factors as, for example, the phase ratio of the emulsion itself, the amount and effectiveness of the emulsifier employed and the type of fuel selected. The actual value for the recirculation quantity is simply determined in operation by reducing the flow rate of pump 8 and observing the state of the final product. If phase inversion occurs, the quantity or recirculating coarse emulsion in increased until the dominance of the oil phase is again achieved. To produce a sensitive explosive emulsion containing very small droplet size, the product from mixing zone 1, which consists of a mix of a minor amount of coarse one-pass product and a major amount of finer multiple-pass product, is directed through an additional in-line static mixer 9 and the density of the final product adjusted to a sensitive range by, for example, the addition of gas bubbles or particulate void-containing material.

The in-line static mixture employed in the process of the invention achieves emulsification of the two phases by continuous splitting and layer generation and the rearrangement and reunification of the incoming phase streams. In optimum performance, the mixers are operated under turbulent flow range conditions. Suitable static mixers are the SULZER containing some SMV type mixing elements (Koch Engineering Co. Inc. of New York, U.S.A.) or the ROSS containing some ISG mixing elements (Charles Ross and Son Co. Hauppauge, N.Y., U.S.A.) which static mixing units comprise a number of these stationary elements housed in a pipe. The number and size of the elements can be selected to achieve the desired final product emulsification.

The recirculation pump employed will be of the positive displacement type, and preferably with variable speed. The pump size or capacity selected will depend on ratio of recirculated material to the total production flow.

The following examples describe the invention but are not to be interpreted as a limitation in the scope thereof.

EXAMPLE 1-4

A precursor for a water-in-oil emulsion explosive of the type described in applicant's pending Canadian Application Ser. No. 342,098 filed Dec. 14, 1979 was prepared using the arrangement shown in the drawing. The chemical composition of this emulsion is shown in TABLE I below.

TABLE 1

| w/o Emulsion Composition | |
|---|---|
| Ingredients | Parts by Weight |
| Oil Phase | |
| Emulsifier 1 | 1.7 |
| Paraffin Oil | 2.5 |
| Paraffin Wax | 1.7 |
| Aqueous Phase | |
| Ammonium Nitrate | 61.1 |
| Sodium Nitrate | 14.7 |
| Calcium Nitrate | 3.6 |
| Water | 12.2 |
| Dispersed phase/continuous phase weight ratio = 15.5 to 1.0 or 94% | |

[1]Emulsifier comprising 0.7 parts Soya Lecithin, 0.7 parts Sorbitan Sesqui-oleate and 0.3 parts of a Polymeric emulsifying agent.

The production (total) flow rate was about 4.7 kg/min and the recirculation ratio was about 8 to 1 or 89%, well above the minimum recirculation ratio of about 5 to 1 below which emulsion does not form, or at which emulsion inversion occurred. A low pressure-drop motionless mixer unit was used in the recirculation loop and consisted of 14 Sulzer SMV Type CY mixing elements housed in a 25.1 mm diameter schedule 40 stainless steel pipe, (Ex. 1) Also, three different high pressure-drop motionless mixer units were used in combination with the low-pressure-drop mixer. These high pressure-drop units were:

Example 2

A unit consisting of 10 Sulzer SMV Type DY mixing elements housed in a 9.4 mm diameter schedule 40 stainless steel pipe,

Example 3

A unit consisting of 10 Sulzer SMV Type DY mixing elements housed in a 9.4 mm diameter schedule 80 stainless steel pipe, and

Example 4

A unit consisting of 10 ISG Ross mixing elements housed in a 12.5 mm diameter stainless steel pipe.

The emulsions obtained were examined for droplet size distribution by either optical microscopy at 1,200 magnification or by freeze-fracture electron micrography at 10,000 and 50,000 magnification. The result of this analysis is presented in TABLE II as follows:

TABLE II

Droplet Size Analysis of Emulsions-Recirculation

| Example | Motionless Mixers Combination Unit 3[4] | Unit 3[4] |
|---|---|---|
| 1 | 25 mm Sulzer | — |
| 2 | 25 mm Sulzer | 9.4 mm Sulzer-Sch. 40 |
| 3 | 25 mm Sulzer | 9.4 mm Sulzer-Sch. 80 |
| 4 | 25 mm Sulzer | 12.5 mm Ross ISG |

| Example | Total Pressure Drop (psig) | $\bar{d}_n$[1] (μm) |
|---|---|---|
| 1 | 50–75 | 2.76[2] |
| 2 | 250–300 | 2[3] |
| 3 | 650–700 | 1.32[2] |
| 4 | 750–800 | 1.23[2] |

[1]Number average droplets size.
[2]Analyzed by freeze-fracture electron micrography.
[3]Analyzed by optical microscopy.
[4]As shown in the drawing.

From the results presented in TABLE II it can be seen that the emulsification process and apparatus of the present invention as represented by Ex. 1 to 4 is particularly useful in forming high-phase ratio emulsions with very small droplet size distributions.

EXAMPLES 5–8

In order to compare the effectiveness of the process of Examples 1–4 with a process using identical motionless mixer elements but without any recirculation of product, the emulsion composition of Table I was straight-passed through the mixers without recirculation. The results are shown in Table III below:

TABLE III

Droplet Size Analysis of Emulsions - Straight Pass

| Example | Motionless Mixers Combination Unit 3* | Unit 3* |
|---|---|---|
| 5 | 25 mm Sulzer | — |
| 6 | 25 mm Sulzer | 9.4 mm Sulzer-Sch. 40 |
| 7 | 25 mm Sulzer | 9.4 mm Sulzer-Sch. 80 |
| 8 | 25 mm Sulzer | 12.5 mm Ross ISG |

| Example | Total Pressure Drop (psig) | $\bar{d}_n$[1] (μm) |
|---|---|---|
| 5 | 10–20 | no emulsion |
| 6 | 30–50 | no emulsion |
| 7 | 200–400 | no emulsion |
| 8 | 300–500 | no emulsion |

*As shown in the drawing.

As can be seen by comparing the results in Tables II and III, in order to form an emulsion it was necessary to employ a recirculation loop.

Example 9

A comparison of average droplet size between the emulsion compositions of Table II and emulsions produced using a selection of common homogenizing and/or emulsifying devices was made. The results using common devices are shown in Table IV below.

TABLE IV

Droplet Sizes with Various Emulsifying Devices

| Device | Pressure Drop (psig) | $d_n$ (μm) |
|---|---|---|
| Votator[1] (Reg TM) | 50–60 | 1.75[4] |
| Colloid Mill[2] | 35–40 | 1.31[4] |
| Sonolator[3] (Reg TM) | 575–600 | 0.80[4] |

[1]A 5 H.P. 6" Model Votator CR mixer from Chemetron Process Equipment of Louisville, Kentucky. The emulsion of $d_n$ = 2.76 μm of TABLE II was fed at a rate of 4.7 kg/min to the Votator running at 1,800 rpm.
[2]A 3 H.P. Model 3 Colby Colloid Mill from Canadian Thermopower Industries of Islington, Ontario. A coarse emulsion of $d_n$ of about 5 μm was fed at a rate of 4.6 kg/min to the Colloid Mill running at 5,000 rpm with the gap between the rotor and the stator set at 0.075 mm (3 mils).
[3]A Model 3 Sonolator from Sonic Corporation of Stratford, Connecticut. The emulsion of $d_n$ = 2.76 μm of TABLE II was fed at a rate of 4.7 kg/min through a nozzle of 0.002 inch[2].
[4]Number average droplet sizes analyzed by freeze-fracture electron micrography at 10,000 and 50,000 magnification.

EXAMPLES 10–13

The dispersed phase of an emulsion explosive is typically composed of a highly concentrated nitrate salt solution as exemplified by the composition of TABLE I. It has been observed that a substantial proportion of the individual emulsion droplets can in fact remain in a super-saturated state once the emulsion is cooled below the saturation temperature. For optimum blasting performance and long-term storage stability as an explosive emulsion composition, it is most important to preserve this super-saturation and minimize crystal growth of the emulsion droplets. Two factors appear to have an influence on this phenomenon:

(1) The amount and effectiveness of the emulsifying agent used, and (2) the emulsification process.

In order to further exemplify the merit and utility of the emulsification process and apparatus of the present invention, the stability and sensitivity of emulsions prepared by this process were compared to emulsions prepared by the devices of TABLE IV. To make these emulsions sensitive to cap-initiation in 25 mm diameter charges, 2.5 parts by weight of glass microbubbles were admixed to bring their density to about 1.12±0.02 g/cc in every case. Results are presented in TABLE V below.

TABLE V

Sensitivity/Stability of Explosive Emulsions

| Properties | EX. 10 9.4 mm Sulzer-Sch. 80 | EX. 11 Sono-lator | EX. 12 Colloid Mill | EX. 13 Sono-lator |
|---|---|---|---|---|
| $d_n$ (μm) | 1.32 | 1.75 | 1.31 | 0.80 |
| M. In.[1] (fresh) | R-7[3] | R-9[3] | R-9 | R-9 |

TABLE V-continued

| Sensitivity/Stability of Explosive Emulsions | | | | |
|---|---|---|---|---|
| Properties | EX. 10 9.4 mm Sulzer-Sch. 80 | EX. 11 Sono-lator | EX. 12 Colloid Mill | EX. 13 Sono-lator |
| M. In. after 2 months storage at 35° C. | R-7 | E.B. | E.B. | F.E.B. |
| M. In. after 4 cycles[2] ± 35° C. | R-8[3] | E.B.[4] | E.B. | F.E.B. |
| M. In. after 12 cycles[2] ± 35° C. | R-11[3] | F. 2EB[5] | F. 2EB | — |

[1]Minimum initiator to detonate the explosive in 25 mm diameter charges at 5° C. in all cases.
[2]One cycle consisted of 2-3 days storage at 35° C. followed by 2-3 days of storage at - 35° C.
[3]R-series of detonators are charged with increasing amounts of GAM/PETN. R-7(0.1 g GAM + 0.2 g PETN), R-8(0.1 g GAM + 0.25 g PETN) R-9(0.1 g GAM + 0.3 g PETN), R-11(0.1 g GAM + 0.4 g, PETN)
[4]Electric Blasting detonator containing 0.78 g PETN.
[5]Failed initiation with 2 Electric Blasting detonators.

From results presented in TABLE V, it can be seen that the explosive emulsions prepared by the emulsification process and apparatus of the present invention (Ex. 10) possess outstanding stabilities and sensitivities when compared to compositions prepared by the other emulsifying devices.

I claim:

1. A continuous method for the manufacture of a water-in-oil explosive emulsion precursor wherein the ratio of discontinuous aqueous phase to continuous oil phase is at least 8 to 1 by weight, comprising the steps of:

(a) forming an aqueous salt solution containing at least 75% by weight of oxygen-supplying salt, (b) forming a liquid mixture comprising a hydrocarbon fuel and an emulsifier, (c) passing a stream of said liquid fuel-emulsifier mixture into the inlet of a motionless in-line mixer, collecting said stream from the outlet of said mixer and reintroducing same through a recirculation loop into the said mixer inlet until the said recirculation loop is substantially filled with said fuel/emulsifier mixture, (d) introducing and continuously adding a stream of said aqueous salt solution to the said recirculating fuel/emulsifier mixture stream, the weight ratio of said salt solution to said fuel/emulsifier mixture being at least 8:1, and passing said salt and fuel streams through the said in-line mixer, (e) collecting at least 80% by volume of the mixed streams from the said in-line mixer outlet and reintroducing same through said recirculation loop to the said in-line mixer inlet for further mixing, and (f) withdrawing the mixed unrecirculated and recirculated streams from the said in-line mixer outlet in the form of a stable water-in-oil emulsion explosive precursor while adding an amount of liquid fuel/emulsifier mixture and an aqueous salt solution to the said in-line mixer inlet in an amount equal to the amount of emulsion withdrawn.

2. A method as claimed in claim 1, wherein the said salt solution is maintained at a temperature above the crystallization temperature.

3. A method as claimed in claim 1, wherein the said fuel/emulsifier mixture is formed from converging streams of fuel and emulsifier.

4. A method as claimed in claim 1, wherein the quantity of recirculating material is variable.

5. An assembly for the continuous production of a water-in-oil explosive emulsion precursor, said assembly comprising:

(a) a tubular conduit having an entry end and exit end, (b) means associated with the said entry end for the delivery therein of separate streams of an aqueous salt solution phase and a liquid hydrocarbon fuel phase, (c) an in-line motionless mixer located in said conduit between the said entry and exit ends for the mixing and emulsification of said separate salt solution and liquid fuel phases, (d) a recirculating duct loop connected into said tubular conduit on either side of said motionless mixer, and (e) pump means in said recirculating duct loop adapted to recirculate a portion of said mixed salt solution and liquid fuel phases from an outlet of said motionless mixer to an inlet of said motionless mixer.

6. An assembly as claimed in claim 5 also containing means whereby an emulsifier may be continuously added to the said liquid hydrocarbon fuel phase.

* * * * *